United States Patent [19]

Gustafsson et al.

[11] 4,157,069

[45] Jun. 5, 1979

[54] INITIATION OF BLASTING DETONATORS

[75] Inventors: Åke Gustafsson; Jan Westberg, both of Gyttorp, Sweden

[73] Assignee: Nitro Nobel AB, Gyttorp, Sweden

[21] Appl. No.: 796,690

[22] Filed: May 13, 1977

[30] Foreign Application Priority Data

May 18, 1976 [SE] Sweden ..... 7605608

[51] Int. Cl.[2] ..... F42D 5/00

[52] U.S. Cl. ..... 102/200; 102/206; 361/251

[58] Field of Search ..... 102/23, 70.2 R; 361/251

[56] References Cited

U.S. PATENT DOCUMENTS

| | | | |
|---|---|---|---|
| 3,141,114 | 7/1964 | Jenkins et al. | 361/251 |
| 3,704,393 | 11/1972 | Digney, Jr. et al. | 361/251 |
| 3,721,885 | 3/1973 | McKeown et al. | 361/251 |
| 3,721,886 | 3/1973 | Phinney et al. | 361/251 |
| 3,752,081 | 8/1973 | McKeown et al. | 102/70.2 R |

FOREIGN PATENT DOCUMENTS

| | | | |
|---|---|---|---|
| 922193 | 3/1963 | United Kingdom | 102/70.2 R |

*Primary Examiner*—Charles T. Jordan

*Attorney, Agent, or Firm*—Hane, Roberts, Spiecens & Cohen

[57] ABSTRACT

A method and device for the initiating of a number of electrical detonators by a blasting machine of the type in which a capacitor is charged, the level of the charge being measured by level-sensing units and detonators are initiating by the electrical energy stored in the capacitor by firing after the charge level has reached a given level. The charge level of the capacitor is limited to a range which takes into account the variations of the load between different initiation moments such that the current impulse provided to each detonator assumes a value between a minimum and maximum limit. The limits for each individual load within the operating range of the apparatus is regulated in accordance with the electrical and physical characteristics of the detonators so that safe initiation and a disburance-free firing process are obtained.

22 Claims, 17 Drawing Figures n = 1 n = 4 n = N

INITIATION OF BLASTING DETONATORS

FIELD OF THE INVENTION

This invention relates to the firing of electric blasting detonators and, more precisely, to a method and a device for the initiation of such detonators whereby the energy contents of a capacitor in a capacitor type blasting machine are adapted to suit the demand of the load concerned.

This description includes the concepts of initiation and firing respectively, initiation being here taken to mean the supply of energy needed to start up another process and firing being taken to mean this second process, the firing process, which proceeds independently of external energy supply once it has been started. Thus, for an electric blasting detonator, initiation means the supply of electric energy to its fuse head to such an extent that the actual firing process starts.

PRIOR ART

An absolute demand in connection with the initiation of detonators is that initiation and thereby also firing is carried out with a satisfactory margin of safety so that the risk of misfiring is kept to a minimum. It is also important for the firing of the explosive in the detonator to be able to occur with controlled delay in order to attain the desired result when carrying out interval blasting. In order to meet these demands, it is necessary for the current flowing through the detonator and also for the energy supplied to the detonator to be between predetermined limiting values.

Different types of detonators exist. They are usually divided up into groups and, for each group, a minimum value is given for the current and also the smallest current impulse (firing impulse) which gives rise to safe initiation of a detonator of the group concerned. Current impulse here is taken to mean the time integral of the square of the current. Furthermore, there is also generally indication of the maximum current that can pass through a detonator without any risk of the detonator being initiated.

Detonators for the initiation of explosives in a blasting round are generally connected in series when the number of detonators is small. In the case of larger numbers of detonators, series/parallel connection is used, this imlying that the detonators are divided up into a number of approximately equal groups or series which are then connected to each other in parallel. The detonators within each group are connected in series. This ensures that the necessary voltage that must be fed into the system of detonators can be kept down, whereby the risk of spark-over in the firing system is reduced. Spark-over of this kind implies the risk of misfire, for example by the firing current being short-circuited to earth. In certain countries, pure parallel connection of all the individual detonators is often carried out when conditions permit this.

In conventional capacitor type blasting machines, a battery of capacitors is charged up to a high voltage and the firing current to the connected detonators is produced by, in principle, the closing of a switch and the discharging of the capacitors through the detonator circuit. The state of charge of the capacitors is generally indicated by an instrument with a pointer or sometimes by means of an indicator lamp which lights up when full voltage has been attained. In certain blasting machines, primarily small units, there is automatic actuation when the voltage reaches the determined maximum value. The instruments with pointers are generally not graduated in small volts but only in the form of "0" and "Full charge" as well as possibly a few scale markings in between. At full capacitor voltage, the blasting machine has a certain firing capacity (that is to say the capacity to initiate a certain number of detonators) calculated from the demand made on the minimum value concerning current and current impulse. Below is an example of the way in which a marking plate for a capacitor blasting machine can be designed. The symbols $R_t$, N and n have been added to facilitate the continued description of this invention.

| (n) Number of series in parallel | ($R_t$) Resistance of firing cable | (N) Number of detonators | (N/n) Number of detonators/series |
|---|---|---|---|
| 1 | 10 ohms | 95 | 95 |
| 4 | 10 ohms | 220 | 55 |
| 5 | 5 ohms | 250 | 50 |
| 6 | 2 ohms | 300 | 50 |

The marking plate indicates for different numbers of parallel series (n) the maximum number (N) of detonators that can be initiated on any one occasion and also the maximum number of detonators in each series (N/n) for a given total resistance ($R_t$) of the firing cable used.

The type of marking plate described above indicates, as already mentioned, the maximum number of detonators that can be initiated with a fully charged blasting machine, that is to say the number of detonators for which the blasting machine is designed. If, however, the same blasting machine is to be used to initiate, for example, ten detonators, then there is considerable surplus capacity concerning both energy, voltage and current. The initial current in this case is thus about 8–9 times higher than with 95 detonators connected up. An increase in current of this kind can have a negative effect on the detonator firing process and thereby on the reliability of firing, even if the reliability of initiation in itself is not influenced. This is how the maximum values for current and current impulse are arrived at which can be permitted with the same degree of firing reliability mentioned earlier.

In order to avoid this reliability problem, in the case of conventional capacitor type blasting machines, both upper and lower limits can be stated for the blasting machine in the form of the permissible number of caps to be fired. Such limiting values in combination with the associated values of the number of parallel series can result in the fact that, for a certain individual blasting machine with a given absolute maximum and minimum value for the number of detonators, certain intervals occur between these two limits concerning the total number of detonators, intervals which cannot be initiated by the blasting machine concerned. In order to be able to initiate blasting rounds of the sizes located within these intervals, it is necessary to use blasting machines with other operating ranges. The disadvantage here is that a large number of blasting machines is needed with operating ranges which will often overlap with each other to a considerable extent and this naturally means unnecessarily high cost.

In the case of certain blasting machines, the problem of the marked variation of the load is solved by delivering a firing pulse with controlled current. Independent of the number of detonators connected into the circuit, the individual detonators are provided with the same constant current when these blasting machines are used. Constant current blasting machines, at least those used for the initiation of a large number of detonators, become however complicated in design and this generally implies the risk of an increased defect intensity and makes them unnecessarily expensive for most applications. Another disadvantage of constant current blasting machines is that control is carried out on the "high-power side," that is to say after the capacitors which store the energy. This makes severe demands on the component parts and on the dimensioning of circuits in order to attain a high level of efficiency and in order to avoid transients which are dangerous to the components.

SUMMARY OF THE INVENTION

The invention is directed to a new method and a device for the initiation of detonators whereby the amount of energy emitted from the blasting machine is adapted to suit the number of detonators connected into the system. This is done according to the invention by the charging of the blasting machine capacitor package being adapted to the correct energy level in accordance with the actual load by means of control on the "low-power side" of the blasting machine. The firing pulse itself, on the other hand, as opposed to the constant current blasting machines, can have the characteristic exponential appearance of a capacitor discharge. This method thus limits the current impulse provided to each detonator both upwards and downwards. According to the invention, the capacitor package is charged up to a certain voltage and thereby an energy level which corresponds to the load on the blasting machine. Furthermore, this also provides the significant advantages that in cases when the maximum firing capacity of the blasting machine is not utilized, circumstances which would appear to cover the vast majority of cases, the capacitors are being charged up to a lower voltage than in the case of recognized capacitor blasting machines of a corresponding size. This decreases the risk of earthing faults which naturally provides an even higher level of safety. Control on the "low-power side" also provides the advantage that the blasting machine is simpler, more reliable and costs less to manufacture than a constant current blasting machine.

In one variant of the invention, energy adaptation is carried out by varying the capacitance of the capacitor package. This can be utilized either by always charging the capacitors to a certain determined voltage or alternatively by combining the variation in capacitance with variation of the voltage to which the capacitor package is charged. Variation in capacitance can, for example, be attained by using a number of fixed capacitors which are connected or disconnected.

In all blasting activities, safety matters are of vital importance. This means that a very severe demand is made on reliable operation of a blasting machine. The level of safety can be raised even higher if the blasting machine in itself includes devices which prevent attempts to initiation of detonators when certain faults occur in the system connected up or when the performance of the blasting machine does not correspond to the load connected up. Furthermore, the handling of a blasting machine must be as simple as possible in order to prevent mistakes on the part of the operator to the greatest possible extent. These conditions have been the guide-lines in the development work behind this invention.

It has already been stated that detonators are connected to a blasting machine through series connection, through series/parallel connection or through pure parallel connection. The load resistance sensed by the blasting machine thus depends on the number of detonators connected up (N) as well as the number of series of detonators (n) connected in parallel. According to the idea behind this invention, the operator can, for example with the aid of a switch on the blasting machine, specify the number of series connected in parallel, unless the blasting machine is intended only for the firing of single series. The blasting machine includes a conversion device which, during the charging of the blasting machine capacitor package, converts the capacitor package voltage to the number of detonators of a certain type which, as a maximum, can be initiated at the voltage concerned. Naturally, as an alternative, conversion can instead be carried out to the maximum number of detonators in each series connected in parallel. The relationship between capacitor voltage, the number of detonators connected up (N) and the number of series connected in parallel (n) is not linear, and therefore the conversion device mentioned has a non-linear characteristic. The value calculated by the conversion unit is presented by the apparatus by means of an indicator unit, for example an instrument with a pointer or a digital display instrument. From the view-point of safety it may also be advisable to allow the presentation unit to indicate the value set by the operator for the number of series connected in parallel. When the presentation unit indicates the correct values, that is to say the same number of series and detonators as in the blasting round concerned, then charging of the capacitor package is interrupted.

The concept behind the invention also includes, as specified above, the possibility of introducing safety functions into the blasting machine. This means that the apparatus can, for example, measure the load resistance and on the basis of this use conversion circuits, simultaneously with the circuits mentioned above, to analyse whether the voltage is sufficiently high to provide reliable initiation of the detonators. The blasting machine can, for example, be fitted with a signal lamp, which lights up when initiation may be carried out and/or with a device which, for example mechanically or electrically, blocks any attempts at carrying out initiation too early. In a similar way, in the case of excessively high capacitor voltage, the signal lamp can go out and/or a warning lamp light up or blocking devices can come into operation, respectively. The measurement of resistance can also influence systems arranged to block charging of the capacitors in cases when the maximum capacity of the blasting machine is exceeded. In this case, too, a signal device can be initiated in order to inform the operator about the conditions concerned.

According to the concept of the invention, the blasting machine can, as an alternative, be arranged in such a way that units in the blasting machine measure the actual load resistance, whereupon the conversion unit in the blasting machine, on the basis of measured resistance, value set on the switch for the number of series in parallel and possibly also one for the type of detonators, controls or possibly regulates the charging of the capacitors in the capacitor package so that the correct energy contents are obtained in order to ensure reliable firing of the detonators connected to the blasting machine. Actuation of the firing pulse can then occur automatically or be controlled by the operator who has by means of a suitably designed unit, for example a lamp signal, previously been informed about the fact that the round can now be initiated.

Another variant which makes it possible for the charging of the capacitors to be interrupted at the correct level is that the number of detonators making up the round and the number of parallel series in which the detonators are connected are set by means of switches, whereupon the blasting machine translates these values into the correct voltage.

BRIEF DESCRIPTION OF THE DRAWINGS

The invention is described in greater detail in connection with the drawings where.

DETAILED DESCRIPTION

Figure 1:
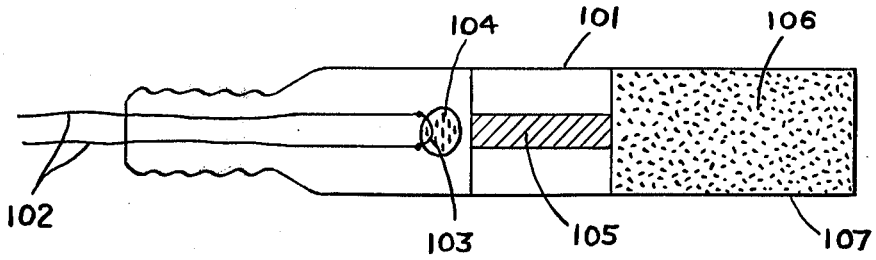
FIG. 1 shows the design, in principle, of a detonator.

FIG. 1 shows a detonator 101. Two detonator wires 102 lead to a filament 103 integral with a fuse head 104. The fuse head is associated with a delay element 105 and, following this, the detonator explosive 106. All the parts mentioned are surrounded by a casing 107. When a current of the right magnitude and durability passes through the wires 102, the filament 103 is effected by the current in such a way that the filament heats up to a sufficient extent to initiate the detonator fuse head 104. The initiated firing process then continues through the delay element 105 with its characteristic burning time and then reaches the explosive 106. This is detonated, as a result of which the explosive in which the detonator is fitted is initiated in its turn.

Figure 2A:
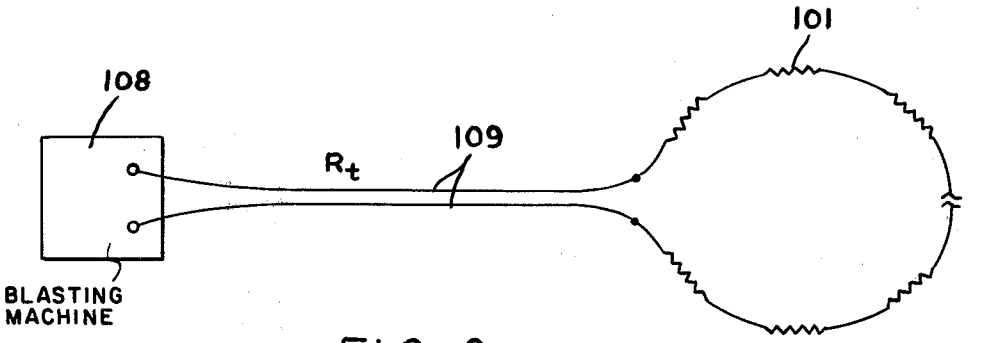
FIG. 2 shows an example of connected-up initiation systems.
Figure 2B:
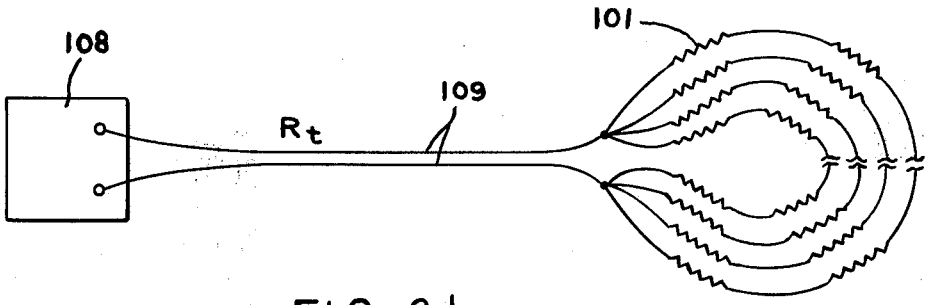
Figure 2C:
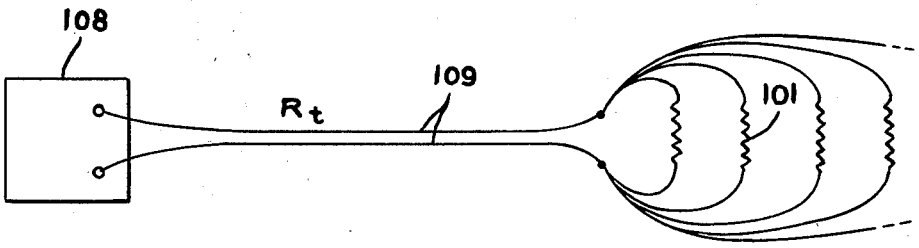

In FIG. 2, 108 indicates a blasting machine which is connected to a number of electric detonators 101 by means of two single conductors or a firing cable 109. In FIG. 2*a* all the detonators are connected in series, while in FIG. 2*b* some groups of detonators are connected in series and each group of detonators connected in series is, in its turn, connected in parallel with other groups. FIG. 2*c* shows a pure parallel connecting system. The figure also includes the designation n which specifies the number of groups or series connected in parallel. Thus, for FIG. 2*a*, $n=1$, for FIG. 2*b*, $n=4$ and for FIG. 2*c* $n=N$. The designation $R_t$ indicates the total resistance of the firing cable 109 used.

Figure 3:
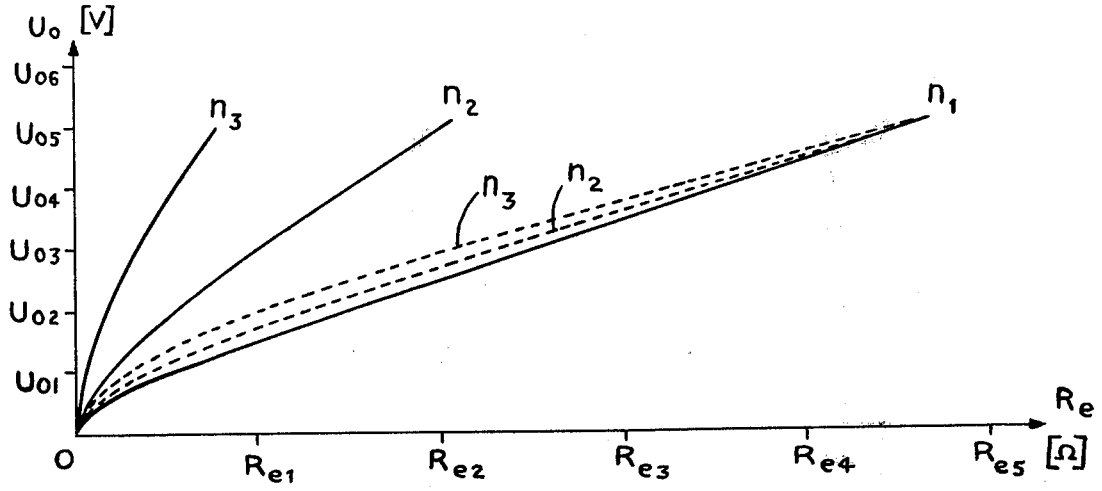
FIG. 3 shows the relationship, in principle, between the load resistance of a blasting machine and the lowest necessary voltage across the blasting machine capacitor package, with the number of series of detonators connected in parallel as a parameter.
Figure 4:
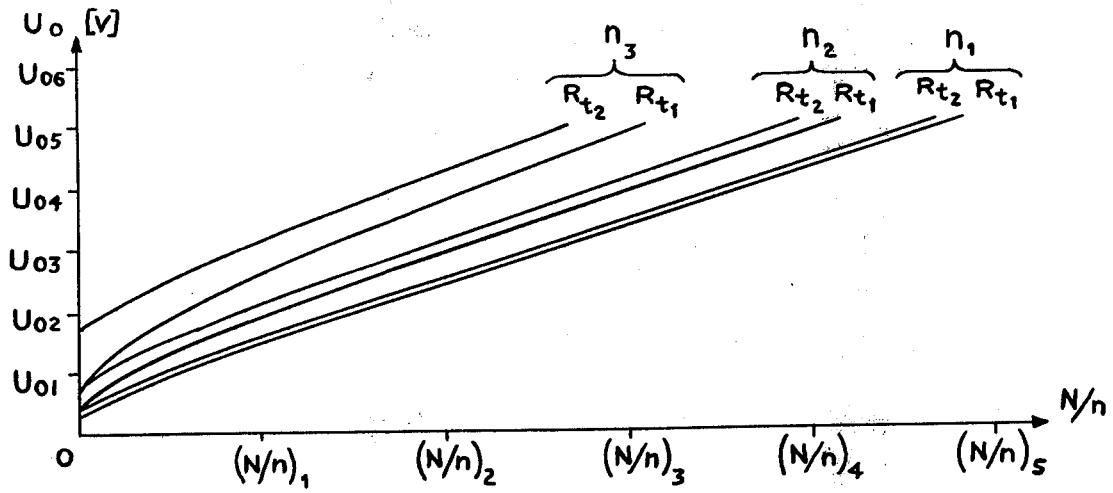
FIG. 4 shows the relationship, in principle, between, on one side the quota between the number of connected-up detonators and the number of series connected in parallel and, on the other side, the necessary voltage across the blasting machine capacitor package, with the number of series connected in parallel as a parameter.
Figure 5:
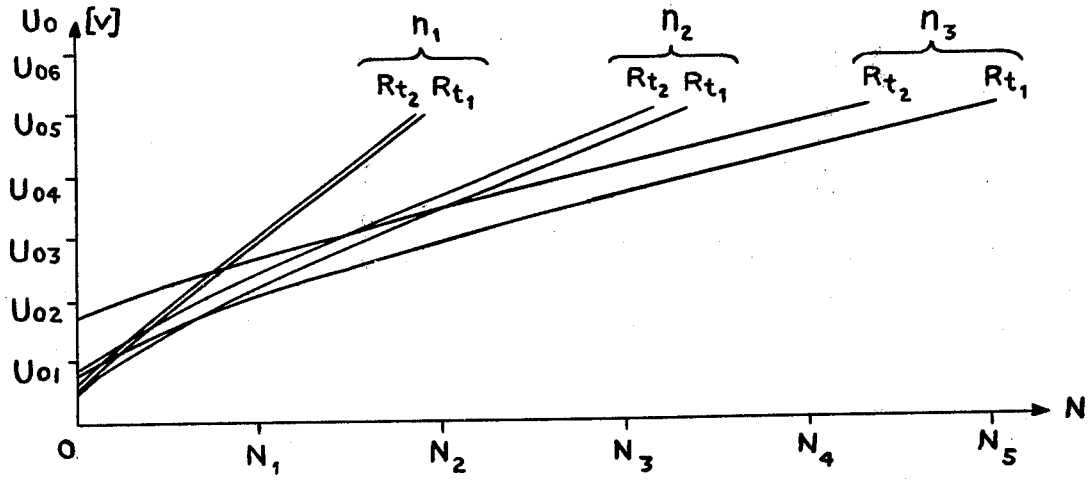
FIG. 5 shows the relationship, in principle, between the total number of connected-up detonators and the necessary voltage across the blasting machine capacitor package with the number of series connected in parallel as a parameter.

FIGS. 3–5 show the relationship in principle between the load on a blasting machine and the minimum necessary voltage $U_o$ across the blasting machine capacitor package with the number of series connected in parallel, n, as a parameter. FIGS. 4 and 5 also indicate how the resistance of the firing cable $R_t$ influences the firing capacity. The load for all the figures is marked along the horizontal axis and the voltage is marked along the vertical axis. The graduation of the axes naturally depends on the magnitude of the capacitance in the capacitor package. For the following general discussion, therefore merely the magnitudes $U_{01}$–$U_{06}$ have been used in the figures to graduate the voltage. For this continued presentation, it has also been decided in FIG. 3 to specify the total load resistance of the blasting machine by $R_e$, in FIG. 4 to specify the load as the quota between the number of loading detonators N and the number of parallel series n, that is to say N/n, and in FIG. 5 to specifiy the load as the total number of detonators N. This graduation has also been applied in magnitudes which are not presented in more detail. FIG. 3 also includes a number of broken lines for various values of n, where the horizontal scale has been varied between the various broken lines so that the respective points for maximum load resistance coincide in the diagram. This implies that the scale on the horizontal axis has been varied in such a way that, for example, the resistance value corresponding to the end point of the broken line $n_2$ is the same as the resistance value corresponding to the end point of the unbroken line for $n_2$. The use of this variation of the horizontal scale is discussed later on in the description. The relationships shown in FIGS. 3–5 are fundamental for the realization of the idea behind the invention, this being clarified in more detail as follows.

Apart from a graphical presentation represented by FIGS 3–5, the relationships can also be presented with the aid of analytical expressions. Since this will be of assistance in the continued description, the various analytical functions are also being introduced at this point. In FIG. 3, the necessary capacitor voltage, $U_o$, is shown as a function of the load resistance, $R_e$, $R_e$ can also be expressed as a function of $U_o$ in accordance with the relationship $R_e=h_{\ddot{o}}(U_o, n)$ which thus implicitly results in the unbroken curves in FIG. 3. In a corresponding way, the curves in FIG. 4 can be presented with the aid of the function $N/n=f(U_o, n, R_t)$ and in FIG. 5 by $N=g(U_o, n, R_t)$. All these functions and curves thus represent *the maximum load* which is permissible for a given capacitor size and voltage or the lowest voltage required to initiate a given load. The basis has thus been to satisfy the demand on a certain minimum current and current impulse to ensure reliable initiation as presented earlier. Furthermore, due respect must be taken to the limitation which represents *the minimum load* which can be fired reliably with a given capacitance and charging voltage or the highest voltage which is permissible with a certain load. This limitation can be expressed analytically as $R_e=h_u(U_o, n)$ and can, if so desired, also naturally be expressed in a similar way for N/n and N.

Figure 6:
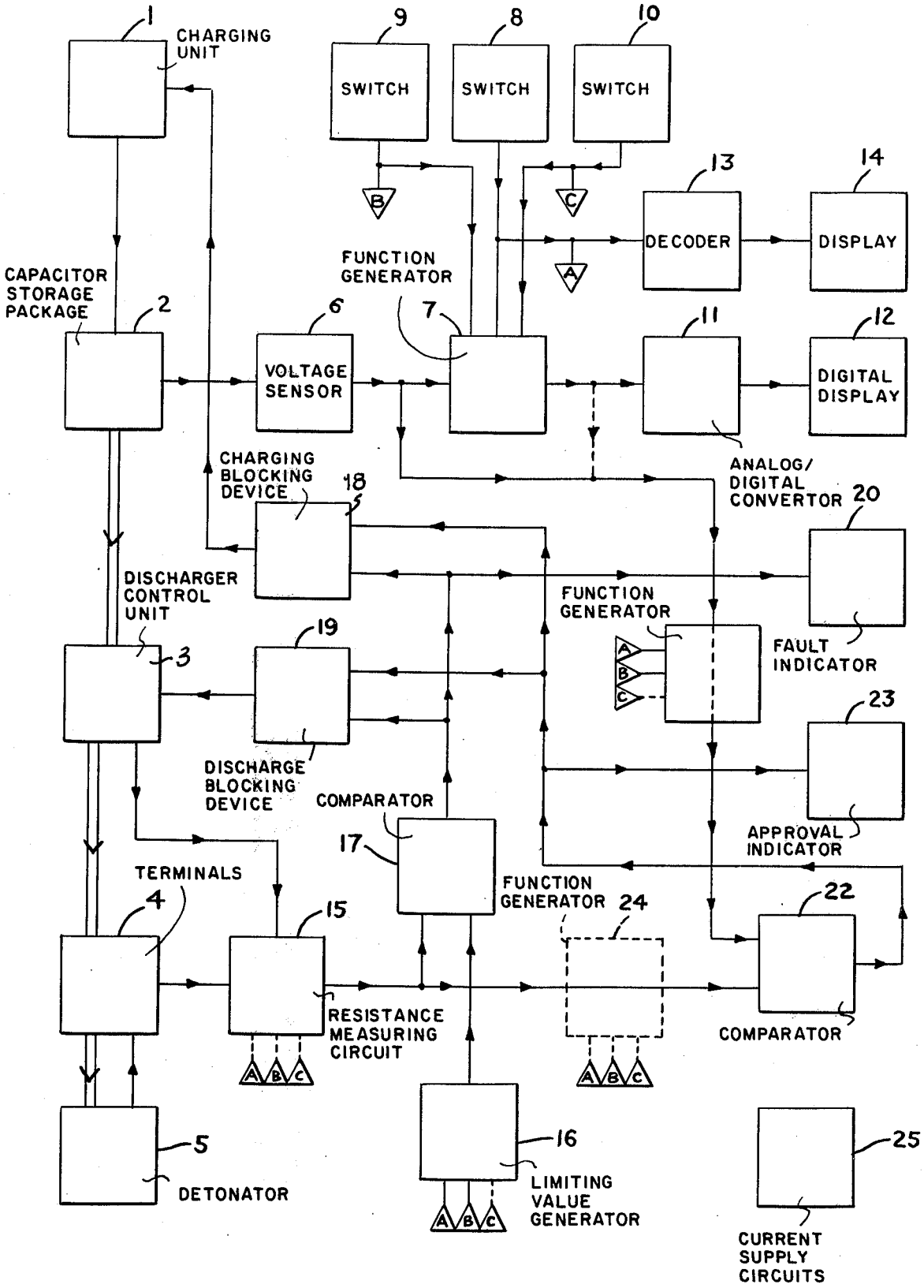
FIG. 6 shows a block diagram for a blasting machine according to one of the variants of the invention.

FIG. 6 includes 25 blocks which describe the method of operation of the blasting machine. In order to facilitate a study of the block scheme, the block numbering is supplemented with symbols. Thus the blocks [1] - [8], [11], [12] and [25] are essential in order to realize the basic principle of the invention. Blocks (15) - (24) refer to safety circuits. Finally blocks 9-10 and 13-14 indicate supplementary devices according to the invention. The figure also includes connecting points A, B and C. The intention is that the points marked in this way in the blocks are in contact with each other where the letters agree.

In FIG. 6, [1] indicates a charging unit for a capacitor package [2] which stores up energy. The source of energy can, for example, consist of accumulators, a manually cranked generator or the electric mains. From the capacitor package there is a heavily marked connection to an operating device [3] for dis-charging of the capacitors. The heavily marked connection which represents the path followed by the firing current, then continues via a pair of terminal screws [4] to a load of detonators [5]. A voltage sensor [6], connected to the capacitor package [2], is designed in such a way that its output signal consists of an analogue signal which is fed into a function generator [7], referred to as the first function generator in the following. In this, the capacitor voltage concerned in converted into a signal corresponding to the number of detonators which the blasting machine can initiate. The transfer characteristic of the function generator agrees in principle with the transfer functions earlier discussed in connection with FIGS. 4 and 5, that is to say the functions $f(U_o, n, R_t)$ and $g(U_o, n, R_t)$. The transfer function to be used depends on whether the number of detonators per series or the total number of detonators is to be indicated to the operator. A switch [8] for the number of series in parallel, n, is connected to the first function generator [7], whereby the set value for the number of parallel series is fed into it. In this way the correct transfer function for the function generator is selected, since n is the differentiating parameter for the curves in FIGS. 4 and 5. Switches for various detonator types and for the firing cable resistance $R_t$ are marked 9 and 10, respectively. Switches for these functions can also influence the choice of transfer function for the first function generator. As a rule, however, these functions become superfluous is most cases and also result in handling of the blasting machine becoming more complicated.

From the first function generator [7], the analogue output signal is fed into an analogue/digital-converter [11], referred to as the A/D-converter in the following. The output signal from this unit still represents the number of detonators that can be initiated but the signal is now in a digital form. This digital signal is fed into a digital display instrument [12] which presents to the operator the firing capacity concerned and makes it possible for him to interrupt capacitor charging at the level which corresponds to the round connected up. In cases when a digital display shows the position of the switch [8] for the number of parallel series, a decoder 13 is connected when necessary to [8]. From the decoder, the signal passes on to the display 14 which can be integral with the digital instrument [12] mentioned earlier. In the same way, where applicable it is naturally also possible for the values set on switches 9 and 10 to be presented to the operator.

One of the systems necessary for the basic function of the apparatus still remains to be described, namely the current supply circuits [25]. In the case of an accumulator or mains powered apparatus, these can to some extent be combined with the charging unit [1]. Primarily in the case of generator-charged blasting machines, however, they will have an independent function since then they only have the task of supplying the electronic section of the apparatus with feed current. For this purpose the circuits consist, apart from the actual source of energy, for example of voltage stabilizers and units for the production of reference voltages. In the case of portable blasting machines where the source of energy consists of batteries, it may also be necessary to introduce an automatic control system concerning battery condition. If the voltage is not sufficient to provide the correct reference voltage for the measurements, etc, to be carried out, the operator must be informed of this. One method, for example, is for all the displays to be cut out.

A blasting machine built merely on the basis of these blocks described is just as reliable in its internal function as a conventional capacitor blasting machine. In addition, this apparatus offers the advantages in accordance with the main principle of the invention concerning adaptation of the charged-up energy to the load. However, the level of safety can be raised even further by the introduction of safety circuits which come into operation if various types of faults should occur. A few safety circuits of this kind are described in the following.

From the load of detonators [5] there is a return connection to the pair of terminal screws [4]. From there there is a continuing connection to a circuit (15), which measures resistance, and symbolizes the possibility of measuring the actual load resistance, $R_L$. A limiting value generator (16) is controlled by the setting of the switch [8] for the number of parallel series and, where applicable, also by signals from switch 9. These connections are represented in the figure by the connecting points A and B. On the basis of the values fed in, the limiting value generator provides an output signal which corresponds to the highest load resistance that the blasting machine can accept with the same level of reliability. It should be pointed out that the firing cable resistance $R_t$ does not influence this maximum permissible load resistance, $R_{max}$, and that it is therefore not necessary to feed in any signal from switch 10. $R_t$, on the other hand, makes up part of the load resistance and thereby influences the number of detonators N which may be connected to the blasting machine. (See FIGS. 3-5).

A first comparing device (17) is fed with signals from the resistance meter (15) and from the limiting value generator (16) and compares both signals. If the load resistance $R_L$ is greater than the highest load resistance $R_{max}$, specified by the signal from the limiting value generator, this comparing device emits signals to a charging blocking device (18) and a discharge blocking device (19). This blocks the charging-up of the blasting machine capacitor package [2] and also the control device [3] for discharge of the capacitor package. In this way the charge that may exist in the capacitor package is prevented from being fed to the detonators.

In one alternative, which is more advantageous from the viewpoint of safety, the blocking units (18) and (19) in their initial positions block both the charging and the discharging of the capacitor package. Not until the first comparing device (17) has determined that the load resistance connected up has a permissible value, does the comparing device emit signals which eliminate the blocking effects. This last-mentioned version provides a higher level of safety in the event of defects in the resistance meter, the limiting value generator or the comparing device.

A fault indicator (20) can also be activated by signals from the first comparing device (17), indicating that the load resistance is outside the permissible range.

The blasting machine can also be supplemented with a second function generator (21), a second comparing device (22), and an approval indicator (23). These units further increase the level of overall safety when using the blasting machine. The actual load resistance $R_L$ is compared here with a theoretical value calculated on the basis of the capacitor package [2] voltage, on the setting of the switch [8] for the number of parallel series and possibly also on the setting of switch 9 for the type of detonators. Only when the signals received by the second comparing device (22) make up a permissible combination, is a go-ahead signal given to the approval indicator (23). This, in common with the digital display instrument [12], then informs the operator that the blasting machine is ready for actuating. A corresponding signal from (22) can, as described earlier, be used at the same time to cancel a blocking position of the discharge blocking device (19).

In a blasting machine fitted with the units described in the previous paragraph, the second function generator (21) is provided with a signal from the voltage sensor [6], a signal which corresponds to the voltage across the capacitor package [2]. The function generator (21) is controlled by the switch [8] and possibly also by 9, and converts the incoming signals to a magnitude corresponding to the permissible load resistance according to function $R_e = h_{\ddot{o}}(U_o, n)$. This makes up the input signal for the second comparing device (22) where it is compared with a signal representing the load $R_L$ sensed by the resistance meter (15). While the capacitors [2] are being charged, to start with, the voltage $U_o$ is too low for reliable initiation and $R_L$ is thereby greater than $h_{\ddot{o}}(U_o, n)$. When the voltage has increased so much that the relationship is reversed, the comparing device provides the necessary signals to the discharge blocking device (19) and the approval indicator (23) so that blocking is cancelled and the indicator lights up. Only then is it possible for the operator to fire the round.

Another section of the second function generator (21) emits a signal representing $R_e = h_u(U_o, n)$ which is also fed into the comparing device (22). If the charging of the capacitors should continue too far for some reason, this results in $h_u(U_o, n)$ exceeding $R_L$ and we enter the range where the firing reliability in the detonators decreases. The comparing device (22) then emits a signal which cuts out the approval indicator and which influences the discharge blocking device to return to its blocking position. This once more makes it impossible to actuate the blasting machine. If so desired, the signal from the comparing device can naturally instead be used to interrupt capacitor charging so that the limit mentioned above is not exceeded.

One alternative to the blasting machine layout described is for a third function generator (24), shown in the form of broken lines in the block diagram, to convert the output signal from the resistance meter (15) before it is fed into the comparing device (22). This makes it possible to avoid the conversion which is otherwise necessary in the second function generator (21) which can thus be eliminated. The output signal from the voltage sensor [6] is then taken directly to the second comparing device (22) where comparison is carried out as described earlier. The function generator (24) is also controlled by switches [8] and 9, represented by connection points A and B marked in on the block drawing.

Yet another possible signal route can be mentioned. No matter whether a decision is made to utilize the second function generator (21) or the third function generator (24) (or both), instead of the output signal from [6], corresponding to capacitor voltage, the output signal from [7] can be used which represents the corresponding limit for firing capacity. This signal route is marked in the block diagram in the form of a broken line. This can naturally appear more natural and simpler since the relationship between the load resistance and the number of detonators in linear. It can be shown in a simple way that the relationship follows the expression $R_e = R_t + N \times R_s/n^2$, where $R_s$ is the resistance of one detonator (see FIG. 2). The linear relationship is simple to represent exactly and can thereby simplify the circuits for the function generators (21) and (24) compared with the non-linear transfer functions which are needed theoretically in other alternatives. The relationship above indicates, however, that the function generators when used with this choice of signal route, must be informed about the setting of the switch for firing cable resistance symbolized by connecting point C, indicated by a broken line to the function generator (21). The variant described has also, however, a serious disadvantage from the viewpoint of safety. If a defect should occur in the first function generator [7], this will also influence the safety circuits which can make it impossible for the operator to detect the fault concerned and can make it permissible for the blasting machine to be operated with a faulty energy level. If the signal under discussion is taken from the voltage sensor [6], on the other hand, the safety circuits will function independent of most defects that can occur in the function generator [7], in the A/D-converter [11] and in the digital display [12].

As has already been mentioned, the blocking circuits in the apparatus can either be activated or deactivated by the signals received. Naturally, within the range of the invention, this can be carried out in many different ways. The signals, for example, can consist of logical levels "high" and "low," or of some type of coded information in the form of pulse trains or similar systems. The blocking units can be allowed either to be controlled by the absence or presence of these signals, or both the blocking positions and the non-blocking positions can be allowed to correspond to continuously received signals with different forms. The design of the indicators can also be varied so that their functions described earlier are inverted and/or so that they are controlled by any of the signal types mentioned above in connection with the blocking units. The alternative chosen then naturally determines the circuits and components to be used for the individual units.

If the blasting machine has not been made completely proof from short-circuits in some other way, it can be advisable to develop the limiting value generator (16) in such a way that it also emits a signal corresponding to the absolutely lowest load, $R_{min}$, which may be connected to the terminal screws. This then provides protection for the blasting machine (primarily for switches and other actuating devices) and not for the detonators since their safety is taken care of by other functions. The lower limit for the load can thereby be set to a value corresponding to the resistance $R_s$ of one detonator with respect to the low charging voltage achieved with these low resistance values, while a pure short-circuit cannot be accepted as a rule. A choice of limit made in this way will furthermore not influence the operating range of the blasting machine expressed in number of detonators and will thus not influence its flexibility either.

With this version of limiting value generator (16), it is also necessary for the first comparing device (17) to be supplemented so that it can also determine the relationship of $R_L$ compared with $R_{min}$.

The description of the working method given here in connection with FIG. 6 for a blasting machine in accordance with the invention does not in any way claim to be comprehensive by this being taken to mean that it covers all conceivable variants of the idea behind the invention. It must be considered more as an illustration to and a concrete example of one layout system which is suitable in practice.

The circuits for a blasting machine built according to the block diagram described can be made up in most blocks by means of electronic units of more or less standard character. In the same way, the charging unit [1], the capacitor package [2], the control unit [3] and the pair of terminal screws [4] can be made up on the whole according to the technique used earlier. In the following, therefore, practical realization of the block diagram in FIG. 6 will be discussed in detail only in cases where the block concerned requires special adaptation or must be of a special model in order to fill the functions specified above for the blocks in question.

Figure 7:
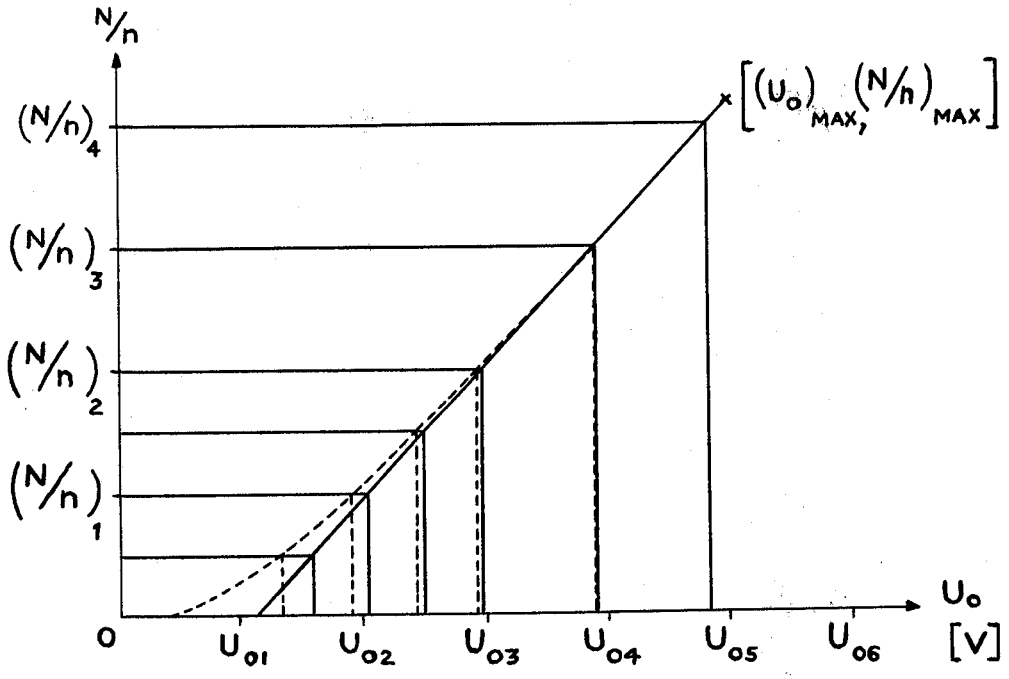
FIGS. 7–8 show examples of piecewise-linear transfer functions suitable for application in the conversion devices of the blasting machine.
Figure 8:
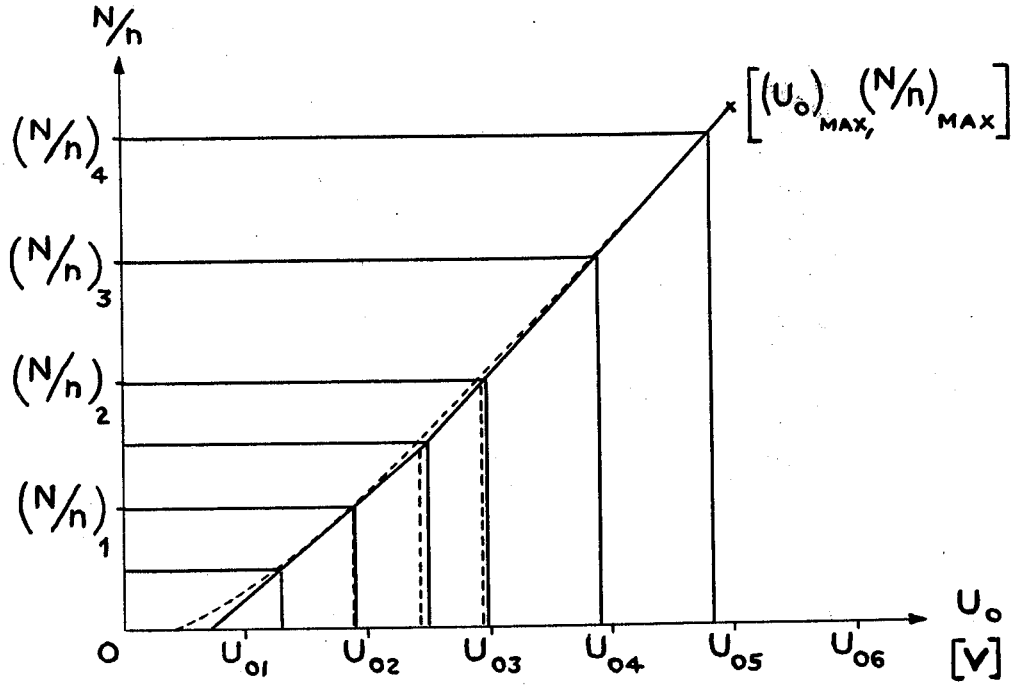

FIGS. 7 and 8 show the appearance in principle of a transfer function between capacitor voltage, $U_o$, and the number of detonators per series connected in parallel, that is to say $f(U_o, n, R_t)$. This function is shown by means of a broken line. The transfer function concerned corresponds to one of the functions shown in FIG. 4, but in FIGS. 7 and 8 the axes have changed places compared with FIG. 4. The figures also show how the transfer function above the $U_o$ axis can be approximated by a straight line (FIG. 7) or by a piecewise-linear function (FIG. 8).

As described earlier, the first function generator [7] combines the signal from the voltage sensor [6] with signals from switches [8] and possibly also 9 and 10 concerning the number of detonator series connected in parallel, the type of detonators and the firing cable resistance into an output signal to the A/D-converter corresponding to the highest permissible number of detonators connected up. This number can, also as described above, either be specified in the form of information about the total number of detonators, N, or in the form of information about the permissible number of detonators in each series connected in parallel, N/n. In the following there will only be a discussion of the practical realization of a transfer function for the emission of a signal corresponding to N/n but the realization of a transfer function for a signal corresponding to N is, in principle, the same. The transfer function of the first function generator corresponds here, in other words, to the transfer functions shown in FIGS. 7 and 8.

On the market today there are function generators made up in accordance with the integrated technique which can be trimmed for good approximation of various functions. They do have the disadvantage, however, that they are relatively expensive. In a blasting machine according to this invention, there is no need of such an accurate approximation of the transfer function as that provided by such function generators. The demand made in this blasting machine on the function generator [7] is that in every conceivable case of load, when the detonators are initiated, the capacitor voltage must be higher than the lowest permissible voltage but below the voltage limit at which there is a decrease in the level of firing reliability. These less severe demands on the function generator imply that the circuit becomes less expensive than in the case of more sophisticated function generators which can be bought in a complete condition.

An absolute demand on the approximation made up by the generated transfer function is that it never approaches the vertical axis closer than the corresponding function shown as a broken line in FIGS. 7–8. Furthermore, it should not be able to produce negative values of N/n. In order for the firing capacity of the blasting machine not to be influenced in a negative direction by the approximation, the curves must coincide as closely as possible at large vaues of $U_o$, that is to say in the right-hand sections of the diagrams. These demands are met in the simplest way if the function generator transfer function corresponds to the unbroken line in FIG. 7 which passes through the point $((U_o)_{max}, (N/n)_{max})$, the inclination of which agrees with the derivative of function f at this point and which has a break point at $N/n=0$. The curve form of the broken line indicates that the derivative mentioned is monotonously increasing and therefore the unbroken line is then always located to the right of the broken line. This satisfies the safety demand made on the lower limit of capacitor voltage. Such a "linear" transfer function of the function generator is in itself quite sufficient to provide the security brought about by the idea behind the invention against unnecessarily high voltages (risk of earthing fault) and unnecessarily high current impulses (disturbance of the detonator firing process). In the case of a low number of detonators, the capacitor voltage according to the invention is low and therefore there is little risk of these phenomena occurring, even if the transfer function of the function generator at low voltages has a relatively large deviation from the theoretically correct curve (see FIG. 7).

A better approximation at low voltages, however, is also simple to attain. It is in fact easy to generate polygon functions which give a piecewise-linear approximation of a desired function. The upper segment in the polygon is conveniently chosen in the same way as already described for the "linear" approximation concerning inclination and tangent point with the broken-line curve. Other segments are chosen on the basis of the fact that they must not be located above the correct curve but, on the other hand, they should be as close to it as possible. This also implies that these segments, too, are at a tangent to the function f. The exact choice of segments is calculated in each individual case in the recognized way by minimizing the maximum approximation fault which is found at the break points. In FIG. 8, for the sake of comparison, the same function as in FIG. 7 has been approximated by means of two linear segments, or in point of fact three, if the section coinciding with the $U_o$ axis is included. Agreement even here is very good as can be seen.

Circuits for the methods mentioned for function generation can be chosen in several different ways. If the input signal to the function generator consists of an analogue voltage, proportional to capacitor voltage $U_o$, then, for example, one of the following solutions can be chosen.

Figure 9:
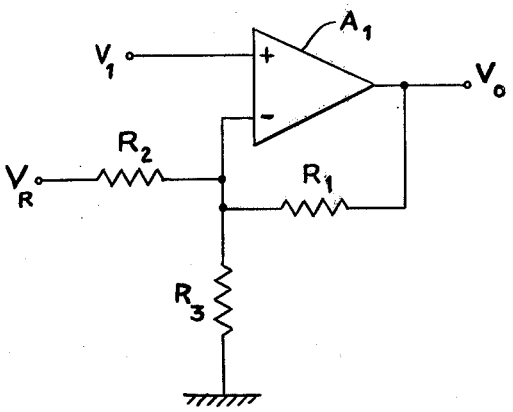
FIGS. 9–10 show proposed wiring diagrams in order to attain the piecewise-linear transfer functions shown in FIGS. 7 and 8, FIGS. 11–12 show a normal diode characteristic and one way of representing a diode with the aid of ideal components.

One circuit for FIG. 7 is shown in FIG. 9 where it can be seen how three resistors $R_1$, $R_2$ and $R_3$ are connected to an operation amplifier $A_1$, referred to in the following as OP-amplifier. The positive input of the OP-amplifier is connected to the output from the voltage sensor [6]. The signal fed into the positive input of the amplifier is designated $V_1$. The three resistors are connected to the negative input of the OP-amplifier. The other side of resistor $R_1$ is connected to the output of amplifier $A_1$, the other side of resistor $R_2$ is connected to a reference voltage, $V_R$, and the other side of resistor $R_3$ to earth. The voltage supply to power the amplifier is not shown in the figure but the OP-amplifier is of a type which can be powered by a single-supply voltage. This means not only simplified current supply but also the advantage that the output signal $V_0$ from amplifier $A_1$ can never become negative if the supply voltage is negatively earthed. This means that the desired break point at $N/n=0$ is automatically achieved without any extra measures.

Amplification is assumed to be high in the OP-amplifier, the input impedance of which is also high. The following expression is thereby obtained for positive output voltages, $V_0$:

$$V_0 = \frac{R_1R_2 + R_1R_3 + R_2R_3}{R_2R_3} \times V_1 - \frac{R_1}{R_2} \times V_R$$

This relationship corresponds to the expression for a straight line with an inclination coefficient of $$\frac{R_1R_2 + R_1R_3 + R_2R_3}{R_2R_3}$$

and the intersection with the ordinate axis $$-\frac{R_1}{R_2} \times V_R$$

This should make up a line at a tangent to the broken line in FIG. 7 at the point $((U_o)_{max}, (N/n)_{max})$. The expression for a line of this type can be noted directly $$N/n-(N/n)_{max}=f'((U_o)_{max})\times(U_o-(U_o)_{max})$$

where $$f((U_o)_{max}) = \frac{\partial f}{\partial U_o}(U_o, n, R_l) \mid U_o = (U_o)_{max}$$

Simplification gives:

$$N/n=f'((U_o)_{max})\times U_o-f'((U_o)_{max}(\times(U_o)_{max}-(N/n)_{max}]$$

This shows that $V_0$ corresponds to $N/n$ and $V_1$ corresponds to $U_o$, which gives:

$$\frac{R_1R_2 + R_1R_3 + R_2R_3}{R_2R_3} = f'((U_o)_{max})$$

and $$\frac{R_1}{R_2} \times \frac{V_R}{k} = f'((U_o)_{max}) \times (U_o)_{max} - (N/n)_{max}$$

where k is a proportionality constant.

With a given ratio between the reference voltage $V_R$ and the proportionality constant k, two equations are obtained in order to determine three unknowns ($R_1$, $R_2$ and $R_3$). This means that either one of the resistances (for example $R_1$) can be chosen relatively arbitrarily and the other two can then be determined from the expressions above, or two of the resistors together can consist of a potentiometer. This means that the sum of these two resistances is constant and once again there are only two unknowns. In order to approximate the various curves representing different n (and $R_l$ and the type of detonators) concerned, different sets of $R_1$, $R_2$ and $R_3$ are engaged by using the switch 8 (and numbers 9 and 10).

Figure 10:
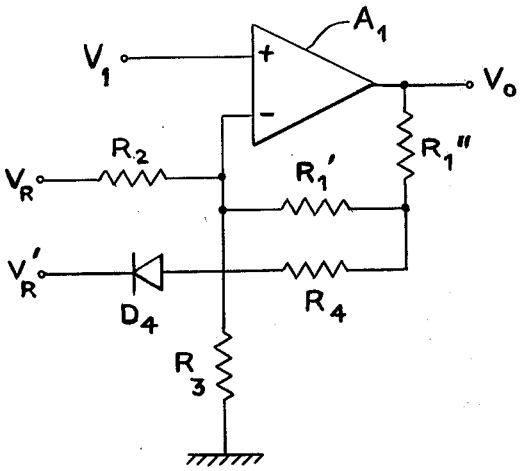

Also to generate a polygon function which approximates the function being sought after, it is sufficient to have one OP-amplifier. A function according to FIG. 8 with one extra break point can then be attained by havng only one external diode with a circuit according to FIG. 10, whereby the break point automatically obtained at $N/n=0$ is utilized. The connection shown in FIG. 10 deviates from the connection in FIG. 9 thereby that $R_1$ has been sub-divided into two resistors $R_1'$ and $R_1''$ connected in series. Of these two, $R_1''$ is closest to the OP-amplifier output. At the connecting point between $R_1'$ and $R_1''$, there is a resistor $R_4$ and is series with this a diode, $D_4$, which in its turn is connected to a reference voltage $V_R'$. The diode is turned so that it blocks the current in the direction from $V_R'$. Otherwise, both the connections are identical.

The expression for the output voltage $V_0$ is the following:

$$V_0 = \left[1 + \frac{R_1''}{R_4} + \frac{(R_1' + R_1'' + \frac{R_1' \times R_1''}{R_4}) \times (R_2 + R_3)}{R_2 \times R_3}\right] \times V_1 - \left[\left(\frac{R_1' + R_1''}{R_2} + \frac{R_1' \times R_1''}{R_2 \times R_4}\right) \times V_R + \frac{R_1''}{R_4} \times (V_R' + U_d)\right]$$

Figure 11:
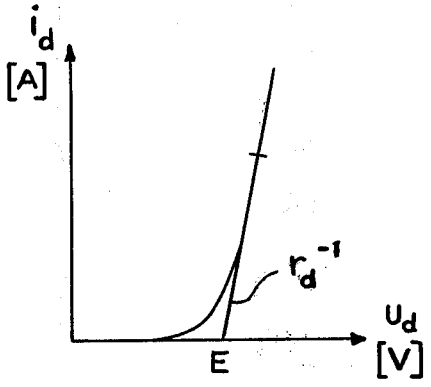
Figure 12:
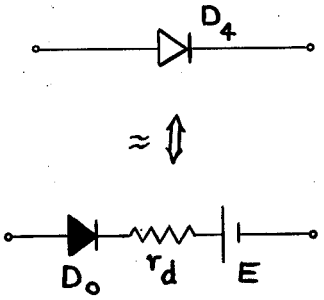

When the relationship between the different voltages is such that the diode conducts, this will provide a certain circuit configuration different from that obtained when the diode is non-conducting. In the last-mentioned case, no current passes through resistor $R_4$, which in the relationship above can be represented by putting $R_4=\infty$. When the diode conducts the voltage $U_d$ is included in the expression and this is the forward voltage drop of the diode. Unfortunately, however, a diode in practice does not make up a linear element. The voltage across it will vary according to the current in the way shown by FIG. 11. One usual way of representing a diode is shown in FIG. 12. The "filled" diode, $D_0$, is thereby an ideal diode (resistance=0 in the forward direction and=$\infty$ in the reverse direction). It is connected in series with a resistor, $r_d$, and a counter-directed source of voltage, E. In this way it is possible to obtain a piecewise-linear approximation of the diode characteristic shown in FIG. 11. The fault in this approximation is greatest at the actual "knee" in the curve but can be made arbitrarily small for the part of the characteristic which is most interesting in connection with the calculations. In the above-mentioned expression for $V_0$, the diode is represented by adding its dynamic resistance, $r_d$, to $R_4$ and by the constant voltage E being used instead of $U_d$.

If, in the case when the diode blocks, $R_4$ (in actual practice $R_4+r_d$) is assumed to be $=\infty$ as specified above, and furthermore, $R_1'+R_1''=R_1$, the following relationship is obtained between the output voltage of the function generator and the input voltage to the same unit:

$$V_0=\left[1+\frac{R_1\times(R_2+R_3)}{R_2R_3}\right]\times V_1-\frac{R_1}{R_2}\times V_R$$

It can be seen that this is the same expression as that for the circuit in FIG. 9. This also appears to be natural if a comparison is made between FIGS. 9 and 10. The lower segment in the polygon function is thus determined by the relationship specified above which applies from $V_0=0$ up to the break point in the diode characteristic. At this break point, the voltage $U_d$ across the diode is equal to E and the current through $R_4$ is $=0$. This gives:

$$V_R'+E=\frac{(R_1'R_2+R_1'R_3+R_2R_3)\times V_0+R_1''R_3\times V_R}{R_1R_2+R_1R_3+R_2R_3}$$

Above the break point, the more complicated expression for $V_0$ applies, this thereby determining the upper segment in the polygon function (after the modifications described above: $U_d$ being replaced by E and $R_4$ being replaced by $R_4+r_d$). When the resistances being sought after are calculated from the relationships above, use is made of the principles for the choice of the different segments presented earlier.

It is worth noting that the approximation made for the diode characteristic implies that the fault in a polygon function realized by a connection of this type (the deviation from the correct curve, function f) will be less than that calculated. From the point where $U_d=0$ and up to the point where the correct diode characteristic is a tangent to the approximation (for $U_d>E$) the "polygon" does not consist of straight lines. Both inclination and position will change continuously between these points in a way that makes the sharp break point being replaced by a rounded transition between the different segments and, thereby, a good association to the function f can be obtained in this area as well.

The following expression for $V_0$ is obtained for the special case where the resistance $R_1'=0$ (and $R_1''=R_1$), that is to say with the resistor $R_4$ directly connected to the negative input of the OP-amplifier:

$$V_0=\left[1+\frac{R_1(R_2+R_3)}{R_2R_3}+\frac{R_1}{R_4+r_d}\right]\times V_1-$$

$$\left[\frac{R_1}{R_2}\times V_R+\frac{R_1}{R_4+r_d}\times(V_R'+E)\right]$$

which gives:

$$V_R'+E=\frac{R_2R_3\times(V_0)_{break\ point}+R_1R_3\times V_R}{R_1R_2+R_1R_3+R_2R_3}=(V_1)_{break\ point}$$

The components can then be chosen in the following way: It is assumed that the reference voltage $V_R$ is given, for example by using a reference diode for this purpose. A theoretical calculation is carried out as to how the segments are conveniently chosen to approximate the desired function in the best way. When the break point and thereby the segments are fixed, four equations are obtained to determine the resistances $R_1$–$R_4$. $V_R'$ can then be determined from the relationship above and can be attained in practice by voltage dividing of $V_R$.

Finally it is to be pointed out once again that an even more improved approximation of the function f can so be obtained by introducing more break points into the polygon function. In practice this is carried out by connecting additional diodes with associated resistors into the circuit. They are then connected to other reference voltages ($V_R''$, etc).

In an alternative solution for generation of the function generator transfer function as shown in FIG. 8, analogue switches, for example constructed in CMOS-technology, can be used together with the OP-amplifier. These switches make up a type of circuit breaker in the semi-conductor technique and they are controlled by logic signals. The resistance in the "on" position is very low and in the "off" position very high. The circuit thereby consists of a level-sensing unit which, at the desired break point, actuates the analogue switch. This then for example, cuts in a resistor in parallel with one of the resistors $R_1$, $R_2$ or $R_3$ (or cuts out a resistor earlier connected in parallel). In this way both inclination and position of the segment can be adapted so that the graph is given the desired curvature. By control of the analogue switches directly from the switches [8], 9 and 10, change-over between different curves can also be attained with this technique.

This concludes the description of the principle of and also examples concerning possible circuits for the first function generator [7] according to the block diagram in FIG. 6. The output signal from the function generator is fed into the analogue/digital-converter [11]. Many different principles are available for A/D-conversion. The invention is completely independent of the solution chosen. In a blasting machine according to this invention, it can however be suitable to use integrated circuits specially adapted for utilization in combination with digital display instruments. These circuits operate in most cases with multiplexing technique which decreases the demand for driving circuits, etc.

When the A/D-converter is calibrated, due respect must naturally be taken to the preceding stages in the signal chain, that is to say the voltage sensor [6] and the first function generator [7]. Trimmming is to be carried out so that with an analogue output signal from the function generator [7] corresponding to $N/n=0$, the digital output signal from the A/D-converter [11] is also $=0$ (zero setting). In the case of increasing capacitor voltage, switch-over to $(N/n)_{max}$ must occur at exactly the voltage provided by the relationship shown earlier, $N/n=f$ ($U_o$, n, $R_t$) (maximum value setting). This means that the settings will vary, depending on the "scale" chosen for $U_o$ and N/n in the analogue circuit section.

Concerning the size of the steps in indication of firing capacity on the digital display instrument [12], note should be made of the fact that the operator can be given a rather puzzling impression if individual detonators are indicated. Steps of 5 or 10 in N/n would appear to be suitable in many cases. In order to realize this, it should be possible for the least-significant figure to assume the values of 0 and 5 or only the value of 0, respectively. The last-mentioned case is very easy to attain (earthing of one point in the circuit), while the first-mentioned case requires a decoder circuit. The input signals to the A/D-converter corresponding to the values of 0–4 in the last figure position are to be represented externally by the figure 0, while signals corresponding to the values of 5–9 externally are to be represented by the figure 5. The fact that decoding is carried out in this way and not according to the usual rounding-off rules is completely in agreement with the principles for the relationship between the maximum permissible number of detonators and the capacitor voltage discussed in connection with the function f ($U_o$, n, $R_t$).

In this context it should be noticed, however, that the size of the steps in indication cannot be determined in a totally arbitrary way. Excessively large steps do imply that the capacitors [2] can be charged up to a considerably higher voltage than what is really needed for a given load. Under certain unfortunate circumstances, the upper permissible limit for the current impulse delivered to each individual detonator can then be passed, the result being that disturbances in the function of the detonator can start to occur. For this reason, if so desired, the blasting machine can be arranged so that units reduce the size of the steps within the voltage range where this condition exists.

Concerning the digital display [12], there are many different systems and makes to choose from and they can be purchased in a complete condition together with the necessary drive stages. Of the alternatives which are available today, light-emitting-diode displays (LED-displays) and gas discharge displays would appear to be most suitable. Decisive factors when making the choice are the aspects of readability and dependability.

Concerning the resistance meter (15), it must automatically measure the resistance in the load of detonators before or at the same time as charging of the capacitors starts. It is therefore convenient to have it operated by means of a closing contact in the charging unit on the blasting machine. The measurement will be done via the terminal screws [4]. When the firing pulse is actuated, there is, however, a very high voltage between the pair of terminal screws and therefore the measuring circuit must then be insulated from them. This can be done, for example, by carrying out measurement via breaking contacts in the control unit [3] symbolized by the connection between the resistance meter (15) and the control unit.

Furthermore, measurement must produce a correct value of the load resistance $R_L$ without any manual adjustment (for example zero setting) being first carried out. The simplest way to attain measurement of this type is by using an automatically regulated, constant current. If current of a known magnitude is fed to the detonators [5], the voltage across them will be directly proportional to the total resistance of the round. Resistance measurement has thereby been transferred to a voltage measurement. According to an alternative solution, a constant voltage is fed out over the terminal screws whereby the current is measured instead. This is, in this case, reversely proportional to the total resistance of the round. A signal of this type is also possible to pass on to subsequent stages in the blasting machine. No matter which measuring method is used, the measuring current must, however, be limited so that there is no risk of accidental initiation of the detonators.

Figure 13:
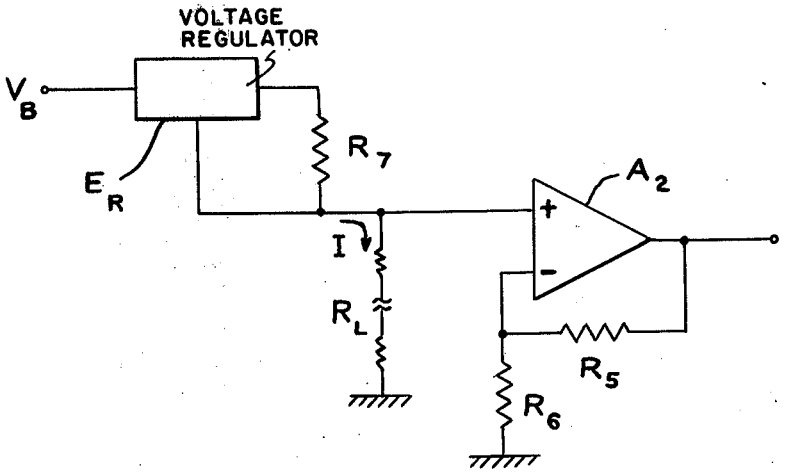
FIG. 13 shows an example of a device for measuring resistance.

If the alternative is chosen where resistance is measured by means of constant current, then, for example, a from the literature recognized circuit can be chosen as shown in FIG. 13. This includes a voltage regulator, $E_R$, and a resistor $R_7$. A supply voltage, $V_B$, powers the regulator. The circuit shown in the figure delivers a constant current, I, within the regulator regulating range and this is insensitive with a sufficient degree of accuracy to the load variations which can occur for a blasting machine. The measuring current, I, supplied by the circuit is fed via the pair of terminal screws [4] out over the detonator load [5], which corresponds in FIG. [13] to the resistor chain $R_L$. The voltage measured across these resistors thus here makes up a direct measure of the load resistance.

Suitable voltage regulators for the circuit described are not difficult to find. It may appear to be a slight disadvantage that in this solution the measuring current, I, is not directly dependent on the main reference voltage, $V_R$, of the apparatus. This fact is compensated for, however, in a simple way by means of an OP-amplifier, $A_2$, with a feed-back network consisting of resistors $R_5$ and $R_6$, inserted before the connection to subsequent stages. The amplifier connection shown is generally recognized. Its amplification, F, is determined by the relationship $$F=(R_5+R_6)/R_6$$

Thus it is possible with this connection to compensate for both normal tolerances of the reference voltage and possible deviations from the nominal value of the measuring current due to component tolerances.

The invention is not dependent on a connection according to FIG. 13 in order to provide a constant current. Also other recognized connections, which, for example, include operation amplifiers, can naturally be utilized as well as the so-called "Norton amplifier" which is specially designed for use in equipment with single-supply voltage.

The limiting value generator (16) is controlled by the setting of the switch [8] for the number of parallel series n, and possibly also by the setting of switch 9 for the type of detonators. For each individual setting of these switches, the output signal from the limiting value generator specifies the highest resistance that the load of detonators can be permitted to reach. As shown in FIG. 3, with maximum voltage across the capacitor package, the maximum value for permissible load resistance varies to a marked extent with the number of parallel series (compare the values for $n_1$–$n_3$). The limiting value generator can conveniently take the form of a set of voltage dividers connected to the reference voltage. This form provides a simple way of adapting the output signals to the voltage given by the measuring current I in FIG. 13 across the load. The voltage from the resistance meter (15) and the voltage from the limiting value generator (16) are therefore directly comparable with each other.

In an alternative version, as described above, resistance measurement is carried out by the magnitude of current through the load being determined at constant measuring voltage. The signal from the resistance meter (15) is thereby inversely proportional to the load resistance. In this case the limiting value generator is made up in such a way that its output signal is inversely proportional to the permissible maximum load. This can also be attained by means of voltage dividers connected to the reference voltage.

Yet another variant for the combination of the signals from the resistance meter (15) and the limiting value generator (16) should be mentioned. In this the limiting value generator provides a fixed output signal which can correspond to the maximum load resistance at a certain number of series, for example n=1. Adaptation so that the output signals from (15) and (16), in spite of this fact, are comparable at all values of the number of series, is thereby carried out in the resistance meter, conveniently by varying the amplification in an amplifier stage which follows the actual measuring circuit. An amplifier wiring as shown in FIG. 13 can thereby be used. If amplification is=1 for n=1 (voltage follower connection) it is increased by the right value for other numbers of parallel series by switch [8] being made to influence what corresponds to the feed-back resistors $R_5$ and $R_6$. This is symbolized in FIG. 6 by the broken-line connection with connection point A.

Concerning the make-up of the comparing device (17), this can consist of a normal comparator or can possibly be made up in the form of a Schmitt-trigger. If one of these solutions is chosen, there are complete components available on the market, for example in the form of integrated circuits.

The charging blocking device (18) prevents the capacitors [2] from at all being charged, if the load resistance is greater than that permitted. One way of doing this is to use a relay controlled by the signal from the comparing device to disconnect the generator in a generator-charged apparatus or the accumulator in an accumulator-powered version. The charging blocking device thereby consists besides the relay merely of the driving circuits for it.

The discharge blocking device (19) can also be made up in a very simple way. In a blasting machine where the firing circuit is closed by means of thyristors, it is easy to prevent the triggering control signal from reaching the control electrode (gate) of the respective thyristor. This needs in principle only a transistor, which is connected parallel with the control electrode and which is saturated by signals from the comparing device whereby the control signal is shunted to earth, or which is connected in series with the control electrode and which is cut-off by signals from the comparing device whereby the control signal is blocked.

The fault indicator (20) which shows the operator that the load is too high and that the blasting machine can therefore not operate, can consist, for example, of a signal lamp or a light-emitting diode. Driving of such units requires no special measures but generally recognized technique can be used for this purpose.

In connection with FIG. 6 it was stated that the resistance meter (15), the second function generator (21), the second comparing device (22) and the approval indicator (23) can also coordinate with the charging and discharge blocking devices (18) and (19) in order to make up yet another safety function. As an alternative the third function generator (24) can here replace the second function generator. The intention of this safety function is to prevent initiation of the detonators connected when the operating conditions of the blasting machine is not satisfied concerning correct adaptation of capacitor energy to the load. Concerning the units involved, the resistance meter (15) and the blocking devices (18) and (19) have already been described.

The task of the second function generator (21) is to produce two output signals representing resistance values, one according to the function $R_e=h_{\ddot{o}}(U_o,n)$ and the other according to the function $R_3=h_u\ (U_o,n)$. The input signal to the second function generator comes from the voltage sensor [6] and control signals from the switches [8] and 9. The circuits can be chosen from FIGS. 9–10 but two circuits of this type are needed in this second function generator, one to generate each function. Since the functions f and $h_{\ddot{o}}$ both represent the same limit of load, the circuit for generation of $h_{\ddot{o}}$ is preferably chosen in the same way as the function generator [7] where the function f is generated. This means that both the units are built up according to FIG. 9 or also both according to FIG. 10. In the first-mentioned case, the transfer function can here be expressed:

$$R_e=h_{\ddot{o}}'((U_o)_{max})\times U_o-(h_{\ddot{o}}'((U_o)_{max})\times(U_o)_{max}-(R_e)_{max})$$

analogously with that applying to N/n and the function f $(U_o,n,R_t)$.

No considerations of this type need to be taken in the generation of the function $h_u$. A slightly rougher approximation of the correct function, for example by using an extra safety margin, has no negative consequences and the simpler circuit shown in FIG. 9 can always be chosen.

In the case of the version mentioned earlier, where the limiting value generator (16) emits a fixed output signal and where the resistance meter (15) amplifies the measured voltage of the detonator load [5] to varying degrees for different numbers of parallel series before feeding it into the first comparing device (17), the function generator (21) can also need to adapt its transfer functions according to this. The function $h_{\ddot{o}}(U_o,n)$ represented by the unbroken curves in FIG. 3 are thereby changed in the way shown in the figure mentioned at the transition from the unbroken to the corresponding broken curves. An analogous change of the function $h_u$ $(U_o,n)$ should also be carried out. The alternative to modifying the second function generator in the way described is to use different input signals to the comparing devices (17) and (22). If the input signal to (17) is taken out after an amplifier stage with varying amplification as described above, then the input signal to the other comparing device (22) is taken out before this amplifier stage.

The second comparing device (22) can be built up in a corresponding way to that described for the first comparing device (17). The second comparring device, however, receives two input signals from the second function generator (21), as described above, and both these signals are to be compared with the output signal from the resistance meter (15). The second comparing device therefore consists of two comparators where the input signal to one input on each comparator represents the actual load resistance $R_L$. The other inputs, one on each comparator, are fed by the signals $R_e=h_{\ddot{o}}\ (U_o,n)$ and $R_e=h_u\ (U_o,n)$. This permits the comparing device (22) to decide the relationship between the energy contents of the capacitor package and the permissible upper limit as well as the lower limit at the load concerned and it can thereby emit the correct signals to the following circuits.

The approval indicator (23) can be built up in the same way as the fault indicator (20). From the viewpoint of safety it can be advisable to choose the colour of the approval indicator and fault indicator signals, respectively, in such a way that in the event of indication that initiation is permissible, the colour of those signals that light up are green and in connection with indication of the fact that initiation is not permissible and in the case of different noticed defects, the colour is red.

In the description above, the make-up of the individual blocks in the block diagram in FIG. 6 have been studied. For some of these, analysis is more detailed than for others, but the intention of the description of the individual blocks is throughout to show that it is possible to carry out the functions needed to realize the idea behind the invention. For each expert within this field it is obvious that the various blocks can be connected to each other and that the component circuits on their respective outputs and inputs can be made up and adapted in such a way that the necessary signals can be transferred between the blocks. The realization of this merely consists of technical adaptation work, the details of which have no significance in understanding the idea behind the invention.

Figure 14:
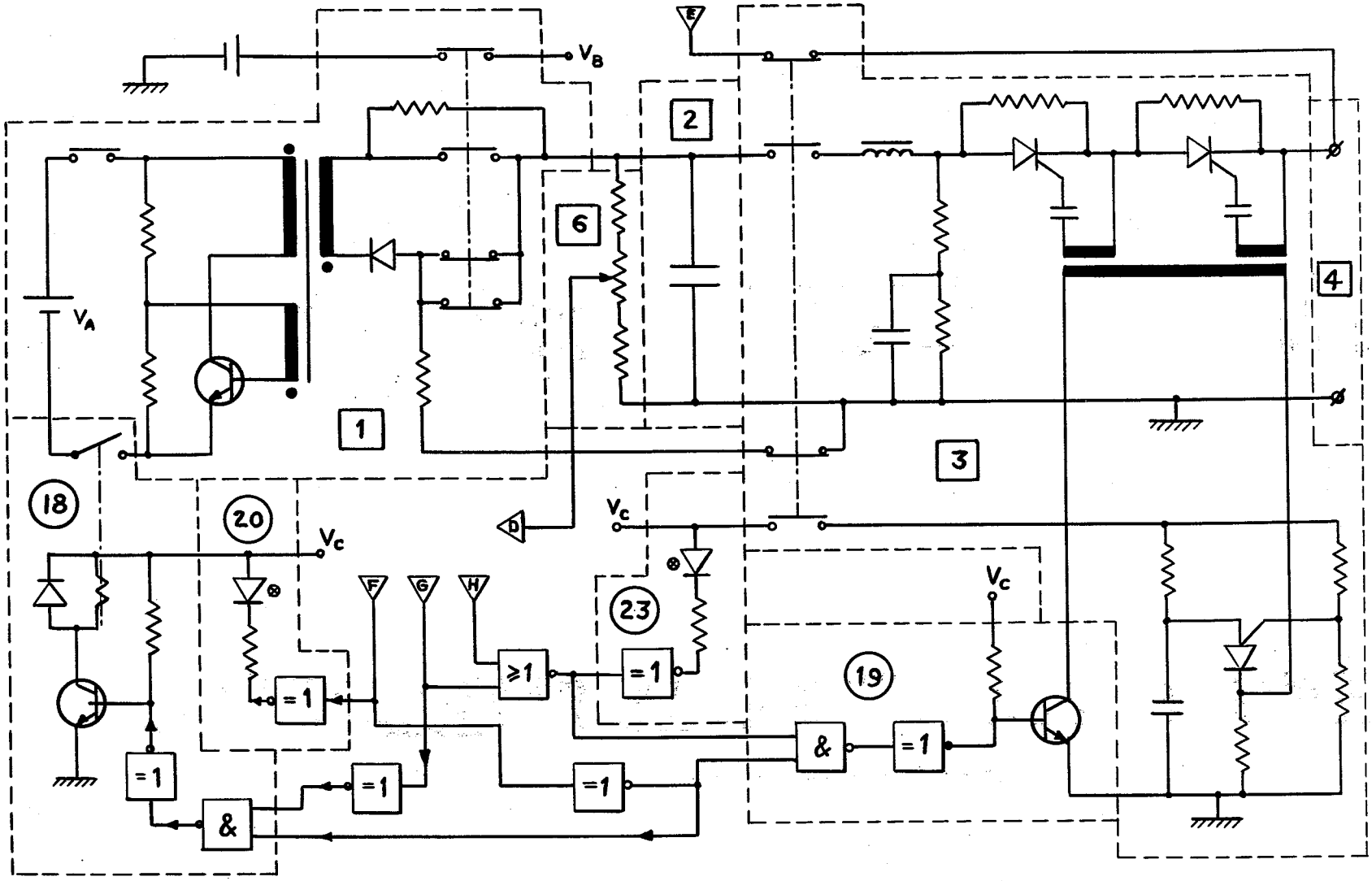
FIGS. 14–15 show circuits in a blasting machine according to the invention.
Figure 15:
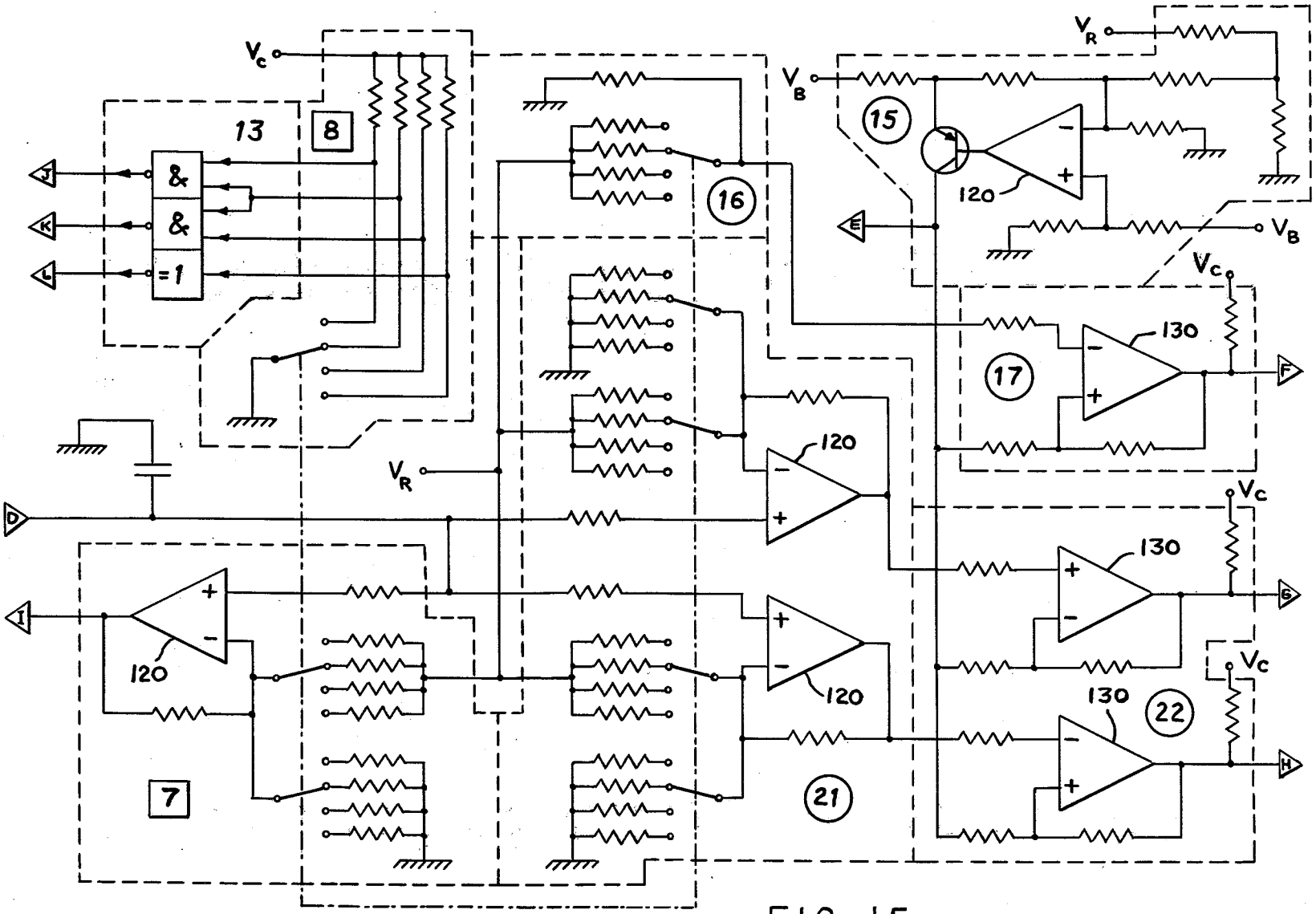

In order, to a certain extent, to provide an example of the make-up of a blasting machine according to the invention, FIGS. 14 and 15 show suggestions concerning the make-up of most of the blocks studied earlier and also indicate how these can be connected together. The example applies to a blasting machine designed for up to four parallel series of detonators. In the figures, the components associated with the same block have been boxed-in and in connection to the boxed components, figures have been stated corresponding to the numbering in the block diagram. Thus, in FIG. 14 there are the blocks [1]-[4], [6], (18)-(20) and (23) and in FIG. 15 the blocks [7]-[8], 13, (15)-(17) and (21)-(22). The blocks missing are either of less significance for the invention and/or can be made up in a corresponding way to some of the blocks that are shown, or circuits from the literature can be applied directly (this applying to blocks [11]-[12] and [25].) In the figures there are symbols concerning both operation amplifiers and comparators. According to normal practice, these symbols are in agreement. In order to facilitate understanding of FIGS. 14–15, in these are therefore used the reference number 120 in order to specify operation amplifiers and reference number 130 in order to specify comparators. With respect to what has been said above, the given circuits in FIGS. 14–15 are not to be further commented on but it can be stated that they are closely associated with the earlier description.

A closer study of the two alternative versions of the invention mentioned in connection with the presentation of its basic principles shows that also blasting machines made up according to these alternatives can have block diagrams as well as circuit diagrams which, on the whole, agree with FIGS. 6, 14 and 15.

The first variant mentioned, where measured load resistance is used in the blasting machine conversion device, can thus in its basic version be realized by units described earlier, namely the charging unit [1], the capacitor package [2], the operating device [3], the pair of terminal screws [4] (to which the detonator load [5] is connected), the voltage sensor [6], the switch [8] for n (and possibly the switch 9 for the type of detonators), the resistance meter (15), the second function generator (21) (or possibly the third function generator (24)), the second comparing device (22), the approval indicator (23) and the current supply circuits [25]. If safety circuits are desired, the following units can be added to the diagram: the limiting value generator (16), the first comparing device (17), the charging blocking device (18), the discharge blocking device (19) and the fault indicator (20). The circuits can be chosen analogous with those earlier. The interruption of charging and the firing of the blasting machine can here be carried out manually by the operator after a signal from the approval indicator (23), charging can be interrupted automatically at the correct level (by the output signal from the comparing device (22) also being fed to suitable circuits in the charging unit [1]), while firing is carried out manually, or actuation of the firing pulse can also be carried out automatically. In this last-mentioned case, no indicator (23) is needed, and the corresponding control signal is fed instead into the control unit [3]. At least in the case of large blasting machines with their relatively long charging times, the operator generally prefers to be able to determine himself the exact time for firing, and therefore the variant with automatic firing in this connection makes up a less satisfactory alternative.

The basic version of a blasting machine where adaptation of capacitor energy is carried out on the basis of a setting of the number of connected-up detonators in the round differs primarily from the previous invention variant by the resistance meter (15) being replaced by switches or similar units with associated circuits. A set of thumb-wheel switches, for example, can be used. If the other circuits are desired to be unchanged, a digital-/analogue-converter (D/A-converter) is then connected-in to convert the set value for the number of detonators to analogue form for comparison in the comparing device (22). Furthermore the transfer function is modified for the second function generator (21) (or for the third function generator (24)) and besides the switch 10 for $R_t$ can be introduced if necessary to control the function generators. The corresponding safety function to the one in the previous type of apparatus, can be obtained through the units with block numbers (16)-(20), if the limiting value generator (16) emits signals which are of the same form as the output signal from the D/A-converter mentioned so that comparison between these two signals in the comparing device (17) has some meaning.

Yet another safety function is obtained if the resistance meter (15) is added. After conversion in a function generator, the output signals from this and from the D/A-converter can be compared in a comparing device, the output signal of which controls a charging and discharge blocking device as well as an indicator. In the block diagram, this is represented besides the extra function generator by duplicating the units numbered (17)-(20). Yet another set of the units (16)-(24) finally permits the measured load resistance also to be utilized for safety functions corresponding exactly to those described in direct association with FIG. 6.

The variant of the invention implying that energy adaptation is carried out partly (or possibly completely) by a variation of the capacitor package [2] capacitance is finally also to be presented in some more detail than earlier. The variant concerned can be combined with any one of the three main alternatives of the invention according to the earlier description. A blasting machine based on these ideas will therefore mainly include circuits corresponding to those earlier described, but naturally supplementary devices are then added to vary capacitance. The necessary switching between different fixed capacitors can, for example, be carried out by using powerful contactors which stand up to the voltage and current levels which may occur, and which are controlled in a suitable way, for example as described below. Those capacitors which are not utilized can thereby be completely disconnected during the entire operating procedure of the blasting machine. As an alternative, each section of the capacitor package that can be connected and disconnected is fitted with its own discharging unit [3] as well as with its own charging circuit [1]. Furthermore using separate discharge devices, no obstacle is in the way for joint charging of all the capacitors if only the individual capacitors, in connection with actuation of the firing pulse, are insulated from each other on the charging side. Control of the operating capacitance is then carried out only on the discharging side.

It must be pointed out in this context that the magnitude of capacitance influences the necessary transfer functions of the function generators mentioned earlier, [7], (21) and (24), so that suitable switching in these circuits are necessary at the same time as capacitance is varied. In its simplest form, a certain capacitance adaptation to the round is easy to carry out. For example merely the switches [8] and possibly 9 for the number of parallel series and types of detonators, respectively, can be made to directly influence the above-mentioned contactors or charging and discharging devices. In more sophisticated versions, it is also, for example, the measured load resistance $R_L$ or the switch setting for the number of detonators connected up in the round which controls capacitance variation.

In the above-mentioned description of the different variants of the invention, there has on one hand been stated the functions which must unconditionally be included in a blasting machine according to the idea behind the invention in order to ensure that it functions in the way described by the method of the invention. Furthermore, safety circuits and other circuits have been added to facilitate the handling of the machine, etc. The basic idea of the invention thus includes the possibility of combining the essential circuits for the realization of the invention with one or more of the supplementary circuits described above. In this way the different variants can be adapted to meet the special demands made by various fields of application. Over and above the description of the idea behind the invention given above, the invention is also characterized by the patent claims appended to the description.

We claim:

1. A method for the initiation of a number of electric detonators by means of a blasting machine of the type in which a capacitor is charged, level-sensing units measure the level of the charge, and detonators are initiated by the electric energy stored in the capacitor being supplied to the detonators, by firing after the intended charge level has been attained, said method comprising limiting the charge level of said capacitor in connection with firing in a limited range which follows the variations of the load between different initiation occasions in such a way, that the current impulse provided to each detonator assumes a value between a minimum and a maximum limit, and regulating said limits for each individual case of load within the operating range of the apparatus to suit the electrical and other physical characteristics of the detonators, so that safe initiation and a disturbance-free firing process are obtained.

2. A method according to claim 1, comprising converting the charge level of the energy-storing capacitor into at least one value of permissible load which can be initiated by the blasting machine and indicating the charge level for direct comparison with the actual load connected to the blasting machine.

3. A method according to claim 1, comprising determining values of the actual load on the apparatus, converting said values of the load into at least one conversion magnitude, which can represent, for safe initiation, the necessary charge level of the energy-storing capacitor and converting the charge level of the capacitor into at least one conversion magnitude, which can represent the associated value for initiation of the permissible load, and comparing the corresponding magnitudes for interruption of the energy charging of said capacitor at said safe initiation level.

4. A method according to claim 2 comprising blocking firing of the apparatus if the actual load on the apparatus exceeds a predetermined level.

5. A method according to claim 2 comprising blocking energy charging of the capacitor if the charge level exceeds a predetermined value.

6. A device for the initiation of a number of electrical detonators comprising a charging unit ([1]), a capacitor package ([2]) connected to said charging unit, a voltage sensor ([6]) connected to the capacitor package for measuring the charge level of the capacitor package, a control unit ([3]) connected to the capacitor package, an outlet unit ([4]) connected to said control unit, and via a firing cable to a detonator load ([5]), said charging unit supplying the capacitor package with electric energy intended for actuation in a firing pulse to the detonators by means of the control unit and via the outlet unit, a function generator ([7]) connected to said voltage sensor such that a signal from said voltage sensor representing the charge level concerned is fed to said function generator, means connected to said function generator to supply the same with a signal indicative of at least one of (a) the number of detonators series connected in parallel, (b) the type of detonators and (c) the resistance of the firing cable connecting the device to the detonators, said function generator converting the signals received into a signal specifying the permissible detonator load for initiation at the charge level concerned, and display means receiving said signals from the function generator for display of the value of the permissible load for direct comparison with the actual detonator load connected to the outlet unit.

7. A device according to claim 6, comprising a resistance meter ((15)) for measuring the load resistance of the detonators connected to the outlet unit ([4]) and the firing cable, a comparing device ((17)) connected to said meter to receive therefrom a signal representing the measured resistance value, a limting value generator ((16)) connected to said comparing device to supply a signal representing resistance values of limits of the permissible operating range with respect to the magnitude of the load, said signal from the resistance meter being compared by the comparing device with the signals from the limiting generator, and a fault indicator ((20)) connected to said comparing device for providing external indication when the comparing device emits an output signal.

8. A device according to claim 7 comprising a comparing device ( (22) ) connected to the voltage sensor ( [6] ) representing the charge level of the capacitor package ( [2] ), a resistance meter ( (15) ) for measuring actual load resistance connected to said comparing device, and a discharging blocking device ( (19) ) connected to said comparing device and to said control unit ( [3] ) for blocking the control unit ( [3] ) when an output signal is produced by said comparing device indicative that the charge level of the capacitor package deviates from that for safe initiation.

9. A device according to claim 6 wherein the capacitor package ( [2] ) consists of at least one capacitor whose capacitance can be varied to control the capacitance of the capacitor package on the basis of the actual detonator load for attaining safe initiation.

10. A device according to claim 6 wherein said display means comprises an analog/digital converter and digital display means connected to said converter.

11. A device according to claim 6, comprising a resistance meter ( (15) ) for measuring the load resistance of the detonators connected to the outlet unit ( [4] ) and the firing cable, a comparing device ( (17) ) connected to said meter to receive therefrom a signal representing the measured resistance value, a limiting value generator ( (16) ) connected to said comparing device to supply a signal representing resistance values of limit of the permissible operating range with respect to the magnitude of the load, said signal from the resistance meter being compared by the comparing device with the signals from the limiting generator, and means connected to said comparing device and to said charging unit for blocking the charging unit when a signal is produced at the output of the comparing device.

12. A device according to claim 6, comprising a resistance meter ( (15) ) for measuring the load resistance of the detonators connected to the outlet unit ( [4] ) and the firing cable, a comparing device ( (17) ) connected to said meter to receive therefrom a signal representing the measured resistance value, a limiting value generator ( (16) ) connected to said comparing device to supply a signal representing resistance values of limits of the permissible operating range with respect to the magnitude of the load, said signal from the resistance meter being compared by the comparing device with the signals from the limiting generator and means connected to said comparing device and to said control unit for blocking said control unit and preventing discharge of said detonator when a signal is produced at the output of the comparing device.

13. A device according to claim 6 comprising a comparing device ( (22) ) connected to the voltage sensor ( [6] ) representing the charge level of the capacitor package ( [2] ), a resistance meter ( (15) ) for measuring actual load resistance connected to said comparing device and approval indicator means connected to said comparing device for providing external indication that actuation of the firing pulse can be carried out.

14. A device according to claim 6 comprising a comparing device ( (22) ) connected to the voltage sensor ( [6] ) representing the charge level of the capacitor package ( [2] ), a resistance meter ( (15) ) for measuring actual load resistance connected to said comparing device, and means connected to said comparing device and to said charging unit for blocking the charging unit when a signal is produced at the output of the comparing device.

15. A device according to claim 6 comprising a comparing device ( (22) ) connected to the voltage sensor ( [6] ) representing the charge level of the capacitor package ( [2] ), a resistance meter ( (15) ) for measuring actual load resistance connected to said comparing device, and means connected to said comparing device and to said control unit for blocking said control unit and preventing discharge of said detonator when a signal is produced at the output of the comparing device.

16. A device according to claim 10 wherein the capacitor package ( [2] ) comprises a plurality of capacitors and means for varying the capacitance of said package on the basis of actual detonator load for attaining safe initiation.

17. A device according to claim 16 wherein said means for varying the capacitance of the package comprises means for selectively connecting and disconnecting individual capacitors.

18. A device according to claim 16 wherein said means for varying the capacitance of the package comprises means for varying the capacitance of individual capacitors.

19. A device according to claim 6 comprising a comparing device connected to said function generator ( [7] ), a resistance meter ( (15) ) for measuring actual load resistance connected to said comparing device, and a discharging blocking device ( (19) ) connected to said comparing device and to said control unit ( [3] ) for blocking the control unit ( [3] ) when an output signal is produced by said comparing device indicative that the charge level of the capacitor package deviates from that for safe initiation.

20. A device according to claim 6 comprising a comparing device connected to said function generator ( [7] ), a resistance meter ( (15) ) for measuring actual load resistance connected to said comparing device, and approval indicator means connected to said comparing device for providing external indication that actuation of the firing pulse can be carried out.

21. A device according to claim 6 comprising a comparing device connected to said function generator ( [7] ), a resistance meter ( (15) ) for measuring actual load resistance connected to said comparing device, and means connected to said comparing device and to said charging unit for blocking the charging unit when a signal is produced at the output of the comparing device.

22. A device according to claim 6 comprising a comparing device connected to said function generator ( [7] ), a resistance meter ( (15) ) for measuring actual load resistance connected to said comparing device, and means connected to said comparing device and to said control unit for blocking said control unit and preventing discharge of said detonator when a signal is produced at the output of the comparing device.

* * * * *